US007802460B2

(12) United States Patent
Tokunaga et al.

(10) Patent No.: US 7,802,460 B2
(45) Date of Patent: Sep. 28, 2010

(54) WORK TRANSFER APPARATUS AND PRESS MACHINE

(75) Inventors: Hidekazu Tokunaga, Komatsu (JP); Masaaki Kashiwa, Komatsu (JP)

(73) Assignee: Komatsu Industries Corp., Komatsu-Shi (JP)

( * ) Notice: Subject to any disclaimer, the term of this patent is extended or adjusted under 35 U.S.C. 154(b) by 432 days.

(21) Appl. No.: 11/884,294

(22) PCT Filed: Feb. 17, 2006

(86) PCT No.: PCT/JP2006/302821

§ 371 (c)(1),
(2), (4) Date: Aug. 14, 2007

(87) PCT Pub. No.: WO2006/088125

PCT Pub. Date: Aug. 24, 2006

(65) Prior Publication Data

US 2009/0039580 A1 Feb. 12, 2009

(30) Foreign Application Priority Data

Feb. 18, 2005 (JP) ..... 2005-043132

(51) Int. Cl.
*B21D 43/04* (2006.01)

(52) U.S. Cl. ..... 72/405.09; 72/405.11; 72/405; 72/13

(58) Field of Classification Search ..... 72/405.01, 72/405.05, 405.09, 405.11, 405.13, 405.16, 72/441, 422; 100/138, 140, 196, 207; 198/621.1; 403/373, 374.2, 374.5
See application file for complete search history.

(56) References Cited

U.S. PATENT DOCUMENTS 6,196,044 B1 * 3/2001 Sofy ..... 72/405.13
6,622,850 B2 9/2003 Noda
2003/0051980 A1 * 3/2003 Sofy ..... 198/621.1

(Continued)

FOREIGN PATENT DOCUMENTS

JP 57-76939 10/1955

(Continued)

OTHER PUBLICATIONS

International Preliminary Report on Patentability, Chapter I of the Patent Cooperation Treaty and Written Opinion for PCT/JP2006/302821 dated Aug. 21, 2007. 4 sheets.

*Primary Examiner*—Jimmy T Nguyen
(74) *Attorney, Agent, or Firm*—Frishauf, Holtz, Goodman & Chick, P.C.

(57) ABSTRACT

A fixed-side connecting portion 151 is provided on an end of the fixed bar 141 while a movable-side connecting portion 152 is provided on an end of the movable bar 142. An air clamp 16 is housed within the fixed bar 141. By pneumatically driving the air clamp 16 while the movable-side connecting portion 152 is superimposed on an upper side of the fixed-side connecting portion 151, a clamp member 165 protrudes from a case 161 to be downwardly rotated and holds the movable-side connecting portion 152 against the fixed-side connecting portion 151. Since the clamp member 165 is pneumatically driven, a die replacement time can be shortened. In addition, since the air clamp 16 is housed within the fixed bar 141, the size of a transfer feeder 41 can be reduced.

9 Claims, 7 Drawing Sheets

U.S. PATENT DOCUMENTS

2005/0056077 A1* 3/2005 Kawamoto ..... 72/405.1
2005/0166659 A1* 8/2005 Baba et al. ..... 72/405.09

FOREIGN PATENT DOCUMENTS

JP 3-90231 A 4/1991
JP 2002/178064 A 6/2002
JP 2002-219535 A 8/2002

* cited by examiner

WORK TRANSFER APPARATUS AND PRESS MACHINE

This application is a U.S. National Phase Application under 35 USC 371 of International Application PCT/JP2006/302821 filed Feb. 17, 2006.

TECHNICAL FIELD

The present invention relates to a workpiece transfer apparatus for transferring a workpiece to be pressed by a press machine and a press machine provided with the workpiece transfer apparatus.

BACKGROUND ART

As a press machine such as a transfer press for performing a plurality of pressing steps, there has been known a press machine that includes a workpiece transfer apparatus for sequentially transferring a workpiece to subsequent steps (e.g., see Patent Document 1). The work transfer apparatus of the press machine includes a workpiece holder for holding the workpiece to transfer, which is supported by a bar provided along the work transfer direction. When a die is replaced, the bar needs to be replaced such that the workpiece holder is replaced. For this purpose, the bar is formed by a fixed bar fixed within the press machine and a movable bar that is separable relative to the fixed bar. When the die is replaced, the movable bar, to which the workpiece holder is attached, is detached from the fixed bar to be placed on a moving bolster, and the workpiece holder is transferred to the outside of the press machine. The workpiece transfer apparatus includes a connecting device for connecting and separating the movable bar with and from the fixed bar.

The connecting device includes plate-like connecting portions provided both on mutually opposing ends of the movable bar and the fixed bar, and a hydraulic clamp is mounted on the connecting portion of the fixed bar. In the connecting portion of the movable bar, an engagement hole is provided to be engaged with the hydraulic clamp of the fixed bar. The hydraulic clamp, which downwardly protrudes form a lower surface of the connecting portion of the fixed bar, includes an engagement portion engaged with the engagement hole of the movable bar and a hydraulic device provided on the upper surface of the connecting portion of the fixed bar for moving the engagement portion in an up-and-down direction and rotating the engagement portion. The connecting portion of the fixed bar is brought into contact with the upper surface of the connecting portion of the movable bar while the fixed bar is moved in the up-and-down direction, and the engagement portion is hydraulically rotated after the engagement hole is penetrated by the engagement portion. While the engagement portion is in contact with the lower surface of the connecting portion of the movable bar, the movable bar is fixed to the fixed bar by pulling up the engagement portion. When the bar is detached in a die replacement operation, the engagement portion of the fixed bar is lifted down and rotated to be positioned to be engaged with the engagement hole, and subsequently the engagement portion is pulled out from the engagement hole by moving the fixed bar to the upper side, such that the movable bar is detached from the fixed bar.

In addition, in another connecting device, the fixed bar is moved relative to the movable bar in a longitudinal direction of the fixed bar, such that end surfaces of the bars are brought into contact to be connected with each other. For example, in a workpiece transfer apparatus where an entirety of the bar is movable in a feed direction (the longitudinal direction of the bar), the fixed bar of a feed drive mechanism side is moved by the feed drive mechanism. Since there is no feed drive mechanism provided for the fixed bar on the opposite side, a disconnecting device is provided for moving the fixed bar. The connecting device includes a claw that can be advanced and retraced in both sides of a direction perpendicular to the longitudinal direction of the bar. The claw is provided to the fixed bar. Further, the movable bar includes either a concave portion or a convex portion as an engagement portion with which the claw is engaged. When the movable bar is connected with the fixed bar, the claw is pressed against the movable bar to be engaged with the engagement portion. When the movable bar is separated from the fixed bar, the claw is moved away from the movable bar to be disengaged from the engagement portion.

[PATENT DOCUMENT 1] JP-A-2002-219535 (page 5)

DISCLOSURE OF THE INVENTION

Problems to be Solved by the Invention

However, in the connecting device having the plate-like connecting portion, the penetration of the engagement portion into the engagement hole increases the movement amount of the fixed bar in the up-and-down direction when the bars are connected and separated. Since the bars are moved at low speed in the die replacement operation, the increase in the movement amount of the fixed bar in the up-and-down direction slows down the die replacement operation, whereby a productivity is reduced.

On the other hand, in the connecting device in which the fixed bar is moved relative to the movable bar in the longitudinal direction of the fixed bar to bring into contact and connect the end surfaces of the bars, the feed drive mechanism or the disconnecting device must be provided. Particularly, in a workpiece transfer apparatus that does not move the entirety of the bars in the feed direction, the disconnecting device must be provided to each side of the fixed bar. Accordingly, the arrangement around the bar separating position becomes complicated. In addition, the movement of the fixed bar in the feed direction slows down the die replacement operation, whereby the productivity may be reduced.

A main object of the present invention is to provide a workpiece transfer apparatus that can shorten a die replacement time and simplify an arrangement around a bar separating position and a press machine having the workpiece transfer apparatus.

Means for Solving the Problems

A workpiece transfer apparatus according to an aspect of the present invention is a workpiece transfer apparatus for transferring a workpiece to be pressed by a press machine that includes: a bar including a workpiece holder that holds the workpiece, the bar being arranged substantially parallel to a transfer direction of the workpiece, in which the bar includes: a fixed bar fixed within the press machine; a movable bar detachable from the fixed bar; and a connecting device that connects the fixed bar and the movable bar, the connecting device includes: a fixed-side connecting portion that protrudes from an end of the fixed bar toward the movable bar; a movable-side connecting portion that protrudes from an end of the movable bar toward the fixed bar to be superimposed on the fixed-side connecting portion; and a holding means that holds the movable-side connecting portion, and the holding means includes: a holding member that is adapted to be advanced and retracted in a longitudinal direction of the fixed bar and holds the movable-side connecting portion against the fixed-side connecting portion; and a driving means that is provided within the fixed bar and drives the holding member.

According to the aspect of the present invention, the movable-side connecting portion is held between the holding member and the fixed-side connecting portion while the fixed-side connecting portion is superposed on the movable-side connecting portion to connect the fixed bar and the movable bar. In addition, by releasing the holding, the movable bar is separated from the fixed bar. Since the holding member is advanced and detracted in the longitudinal direction of the fixed bar, when the movable bar is moved relative to the fixed bar, the holding member can be retracted in the longitudinal direction of the fixed bar. When the holding member is retracted, the holding member does not interfere with the movable-side connecting portion. Accordingly, the movable-side connecting portion can be sufficiently spaced apart from the fixed-side connecting portion, such that the separation distance does not have to be set with accuracy. In addition, since there is no need to take into consideration the separation distance between both the connecting portions in setting a stroke amount of the holding member, the stroke amount of the holding member can be reduced, thereby shortening a die replacement time to enhance a productivity.

Since the driving means of the holding member is housed within the fixed bar, a space utility of the workpiece transfer apparatus can be enhanced, thereby reducing a size of the workpiece transfer apparatus.

In the workpiece transfer apparatus according to the aspect of the present invention, it is preferable that the holding member is movable in a direction toward and away from the fixed-side connecting portion.

According to the aspect of the present invention, since the holding member is movable in a direction toward and away from the fixed-side connecting portion, even when a holding thickness (i.e., a summed dimension of a thickness of the movable-side connecting portion and a thickness of the fixed-side connecting portion) is not constant, the holding member can perform a holding operation.

In the workpiece transfer apparatus according to the aspect of the present invention, it is preferable that the movable-side connecting portion is arranged above the fixed-side connecting portion.

According to the aspect of the present invention, since the movable-side connecting portion is placed above the fixed-side connecting portion, when the movable-side connecting portion is connected with the fixed-side connecting portion, the fixed bar is moved from a lower side to an upper side toward the movable bar until the fixed-side connecting portion contacts the movable-side connecting portion. At this time, when, for example, the movable bar is placed on a table, contacting of the fixed-side connecting portion with the movable-side connecting portion merely raises the movable-side connecting portion from the table, such that no excessive load is applied on the movable-side connecting portion. Accordingly, damages of the movable-side connecting portion can be prevented, and the fixed-side connecting portion does not have to be position-controlled with a high accuracy when moved in the up-and-down direction, thereby facilitating the control.

In the workpiece transfer apparatus according to the aspect of the present invention, it is preferable that a guide pin is provided on one of the fixed-side connecting portion and the movable-side connecting portion to protrude toward the other of the fixed-side connecting portion and the movable-side connecting portion, and that a guide hole into which the guide pin is inserted is provided in the other of the fixed-side connecting portion and the movable-side connecting portion.

According to the aspect of the present invention, since the guide pin protrude toward either one of the fixed-side connecting portion or the movable-side connecting portion, the guide pin can be inserted into the guide hole concurrently with the movement of the fixed-side connecting portion to be superposed on the movable-side connecting portion. Accordingly, positioning of the fixed-side connecting portion and the movable-side connecting portion can be facilitated.

In the workpiece transfer apparatus according to the aspect of the present invention, it is preferable that the holding member is positioned on a side of the fixed bar when the movable bar is transferred while the holding member is moved by the driving means in the longitudinal direction of the fixed bar to be positioned on a side of the movable bar when the movable bar is connected with the fixed bar.

In the workpiece transfer apparatus according to the aspect of the present invention, since the holding member is positioned on the side of the fixed bar when the movable bar is transferred while the holding member is positioned on the side of the movable bar when the movable bar is connected with the fixed bar, the holding member is retracted from the movable-side connecting portion at the time of the movement of the movable bar. Since the holding member is retracted, the holding member does not interfere with the movable-side connecting portion. Accordingly, the movable-side connecting portion can be sufficiently spaced apart from the fixed-side connecting portion, such that the separation distance does not have to be set with accuracy. In addition, since there is no need to take into consideration the separation distance between both the connecting portions in setting a stroke amount of the holding member, the stroke amount of the holding member can be reduced, thereby shortening a die replacement time to enhance a productivity.

In the workpiece transfer apparatus according to the aspect of the present invention, it is preferable that the driving means is pneumatically driven.

According to the aspect of the present invention, since the driving means of the holding member is pneumatically driven, the responsivity of the driving means can be improved, such that an operation of the holding member is performed at high speed, thereby shortening the die replacement time to enhance the productivity.

A press machine according to another aspect of the present invention is a press machine that includes the above-described workpiece transfer apparatus according to the present invention.

According to the aspect of the present invention, since the press machine includes the above-described workpiece transfer apparatus, the same effect as that provided by the above-described workpiece transfer apparatus can be obtained, thereby shortening the die replacement time. In addition, a reduction in the size of the workpiece transfer apparatus improves a space utility of the press machine to reduce the size of the press machine. Further, the die replacement time can be shortened and the productivity is enhanced.

EXPLANATION OF CODES

Figure 1:
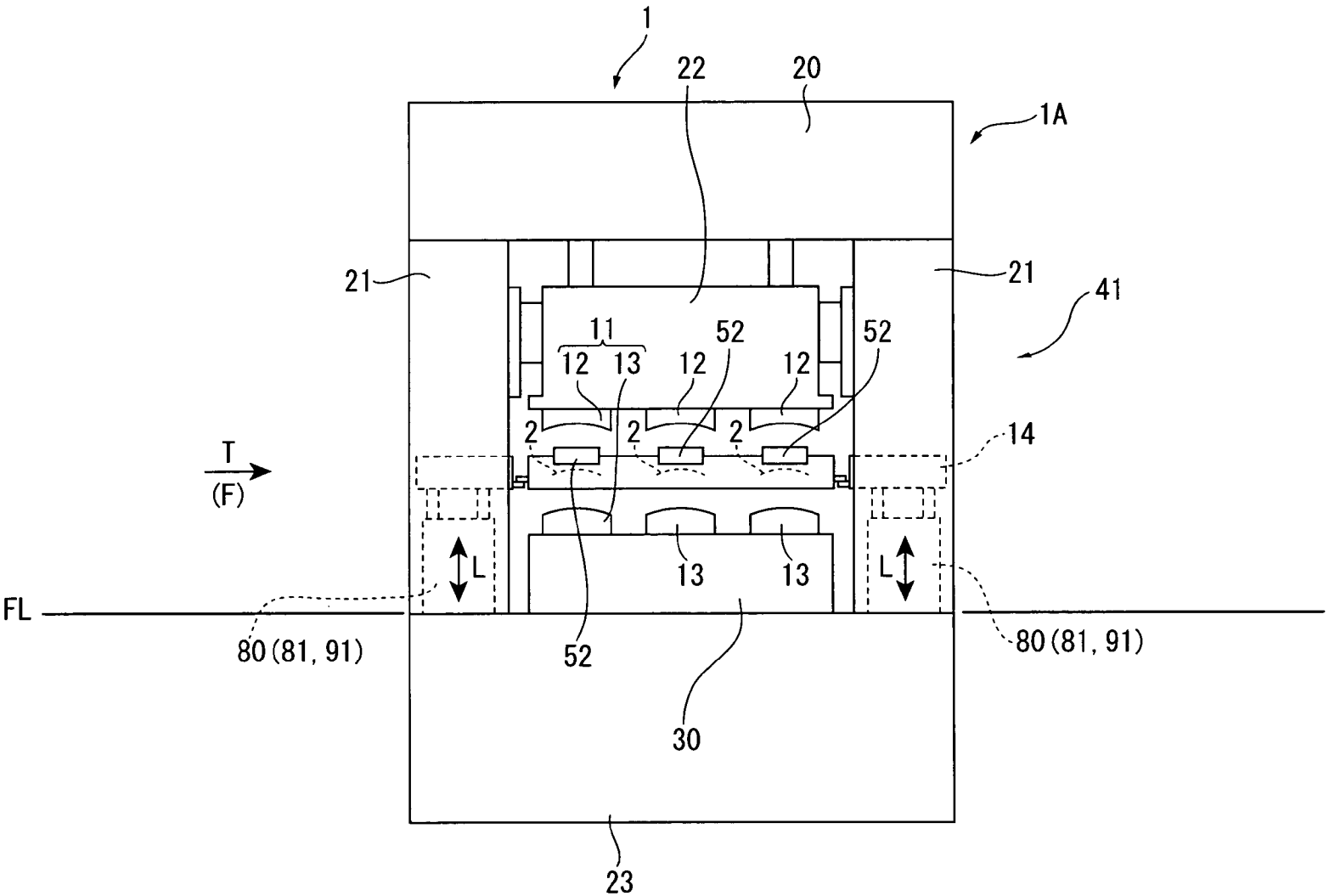
FIG. 1 is a front view showing a press machine according to an embodiment of the present invention.

1: transfer press (press machine);
14: bar
15: connecting device
16: air clamp (holding means)
41: transfer feeder (workpiece transfer apparatus);
141: fixed bar
142: movable bar
151: fixed-side connecting portion
152: movable-side connecting portion
153A: guide pin
153B: guide hole
165: clamp member (holding means)
166: driving means

BEST MODE FOR CARRYING OUT THE INVENTION

An embodiment of the present invention will be described below with reference to the attached drawings.

FIG. 1 is an overall view showing a transfer press 1 (press machine) according to an embodiment of the present invention. In FIG. 1, the transfer press 1 includes a press main body 1A having a bed 23, an upright 21, a crown 20 and a slide 22, a die 11 having an upper die 12 and a lower die 13, a moving bolster 30 and a transfer feeder 41 (workpiece transfer apparatus).

The bed 23 as a base of the transfer press 1 is provided under a floor (FL) while a plurality of uprights 21 (Four uprights are provided in the present embodiment. FIG. 1 shows two of the four) erect on an upper side of the floor, the uprights 21 facing one another in a feed direction F (a direction parallel to a transfer direction T of a workpiece 2) and a clamp direction (a direction horizontally perpendicular to the feed direction F and a direction perpendicular to the paper surface in FIG. 1). The uprights 21 support the crown 20 in which a slide drive device (not shown) is housed and a slide 22 that is adapted to be lifted up and down by the slide drive device is suspended from a lower side of the crown 20 A plurality of upper dies 12 respectively corresponding to press-molding steps are detachably provided on a lower side of the slide 22 sequentially along the feed direction F. On an upper side of the moving bolster 30 provided on an upper side of the bed 23, lower dies 13 that respectively form a pair with the plurality of upper dies 12 are detachably provided to face the upper dies 12.

The moving bolster 30 will be described below.

The moving bolster 30 is adapted to be loaded and unloaded on the upper side of the bed 23 such that a used die 11 (the upper die 12 and the lower die 13) can be replaced with a next die 11.

A rail (not shown) is laid on the floor and the bed 23 and the moving bolster 30 includes a drive device that is adapted to be self-propelled on the rail. The moving bolster 30 is self-propelled by the drive device to pass through in the clamp direction between the pair of uprights 21 provided parallel to the workpiece transfer direction T, such that the moving bolster 30 is unloaded from the inside of the transfer press 1 (or loaded from the outside of the transfer press 1).

Note that two sets of the moving bolster 30 are generally prepared. In order for the dies 11 to be collectively rapidly replaced, one set of the moving bolster 30 on which the used dies 11 are placed is automatically replaced with the other set of the moving bolster 30 on which the next dies 11 are mounted in advance off line outside the transfer press 1.

Next, a transfer feeder 41 will be described in detail.

Figure 2:
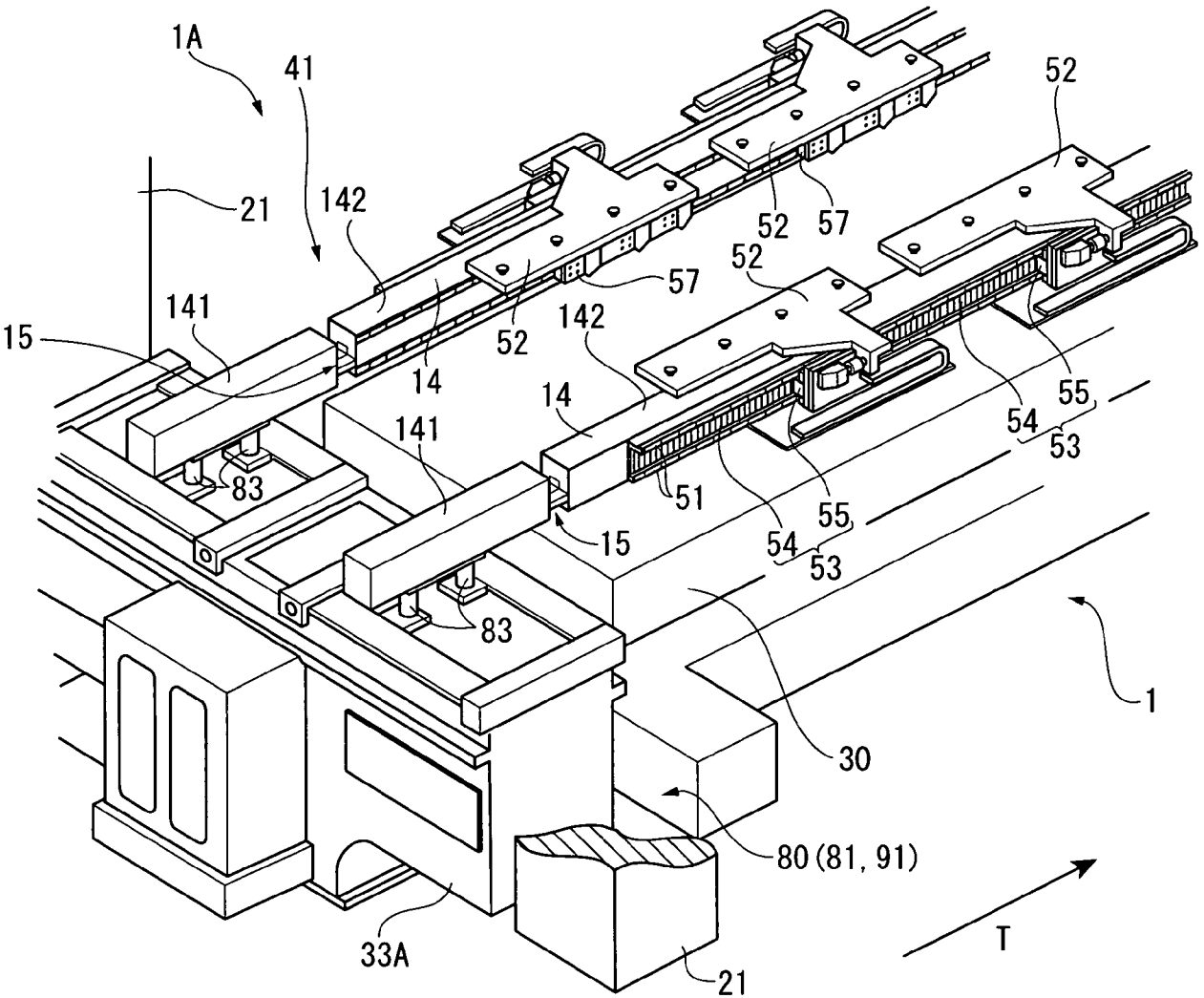
FIG. 2 is a perspective view showing the press machine according to the embodiment of the present invention.

FIG. 2 is a perspective view showing a part of the transfer feeder 41. In FIG. 2, the transfer feeder 41 includes a pair of bars 14 provided on right and left sides relative to the workpiece transfer direction T, a feed carrier 52 movable on the bar 14 in the feed direction F, a feeding linear motor 53 for moving the feed carrier 52 in the feed direction F and a lift/clamp device 80 for moving the bar 14 in an up-and-down direction (a direction perpendicular to the feed direction F, i.e., the clamp direction and a lift direction L shown in FIG. 1) and in the clamp direction.

The pair of bars 14 are provided parallel to the feed direction F with a predetermined space interposed between each other.

Frames 33A are provided on the bed 23 respectively at a portion between the two uprights 21 of an upstream side of the workpiece transfer direction of the moving bolster 30 and a portion between the two uprights 21 of a downstream side of the direction (FIG. 2 only shows the frame 33A of the upper stream side). The lift/clamp devices 80 are provided on the frames 33A. A plural pairs of feed carriers 52 and the feeding linear motors 53 for moving the feed carriers 52 in the feed direction F are provided on the pair of bars 14. A guide rail 57 provided to each of the feed carriers 52 is engaged with a linear guide rail 51 provided at a lateral side of the bar 14, such that the feed carrier 52 is movable on the bar 14 along the feed direction F.

The feeding linear motor 53 includes: a magnet plate 54 as a fixed portion laid along the feed direction F between a pair of feeding rails of an outer lateral surface of the bar 14 (a surface facing a direction in which the pair of bars 14 are away from each other); and a coil plate 55 as a movable portion attached to the feed carrier 52 via a connecting member to face the magnet plate 54. When the coil plate 55 is applied with electricity so that a movable magnetic field is produced, the coil plate 55 is moved due to an attractive force and a repulsive force of the magnet plate 54. The feed carrier 52 is moved together with the coil plate 55, whereby the feed carrier 52 is feed-operated. Since the feeding linear motor 53 is provided to each of the feed carriers 52, the plurality of feed carriers 52 each are independently movable in the feed direction F in a manner that the respective movements are separately controllable.

Although the magnet plate of the linear motor is on the fixed side while the coil plate is on the movable side in the above description, the magnet plate may be on the movable side while the coil plate may be on the fixed side.

Next, the lift/clamp device 80 that moves the bar 14 in the up-and-down direction (the lift direction L) and the clamp direction will be described. The lift/clamp device 80 is provided on the frame 33A of the upstream side and includes a lift device 81 and a clamp device 91.

The lift device 81 includes two lift bars 83 whose upper end is attached to the bar 14, and moves (lifts) up and down the lift bar 83 by rotating a screw (not shown) with a lift driving motor (not shown).

The clamp device 91 moves the two lift bars 83 in the clamp direction by rotating a screw (not shown) with a clamp driving motor (not shown), such that the bar 14 is moved in the clamp direction. When moved in the clamp direction, the pair of bars 14 each are adapted to be moved in opposite directions. In short, the pair of bars 14 are moved in a direction toward and away from each other.

The bar 14 includes a fixed bar 141 fixed to the lift/clamp device 80 and a movable bar 142 that is detachable from the fixed bar 141 when the die is replaced. The above-described lift bars 83 are fixed to the fixed bars 141 provided at ends of the bars 14 Accordingly, the lift/clamp device 80 is provided on each of the fixed bar 141 portions at both ends of the bar 14 (two in total).

Figure 3:
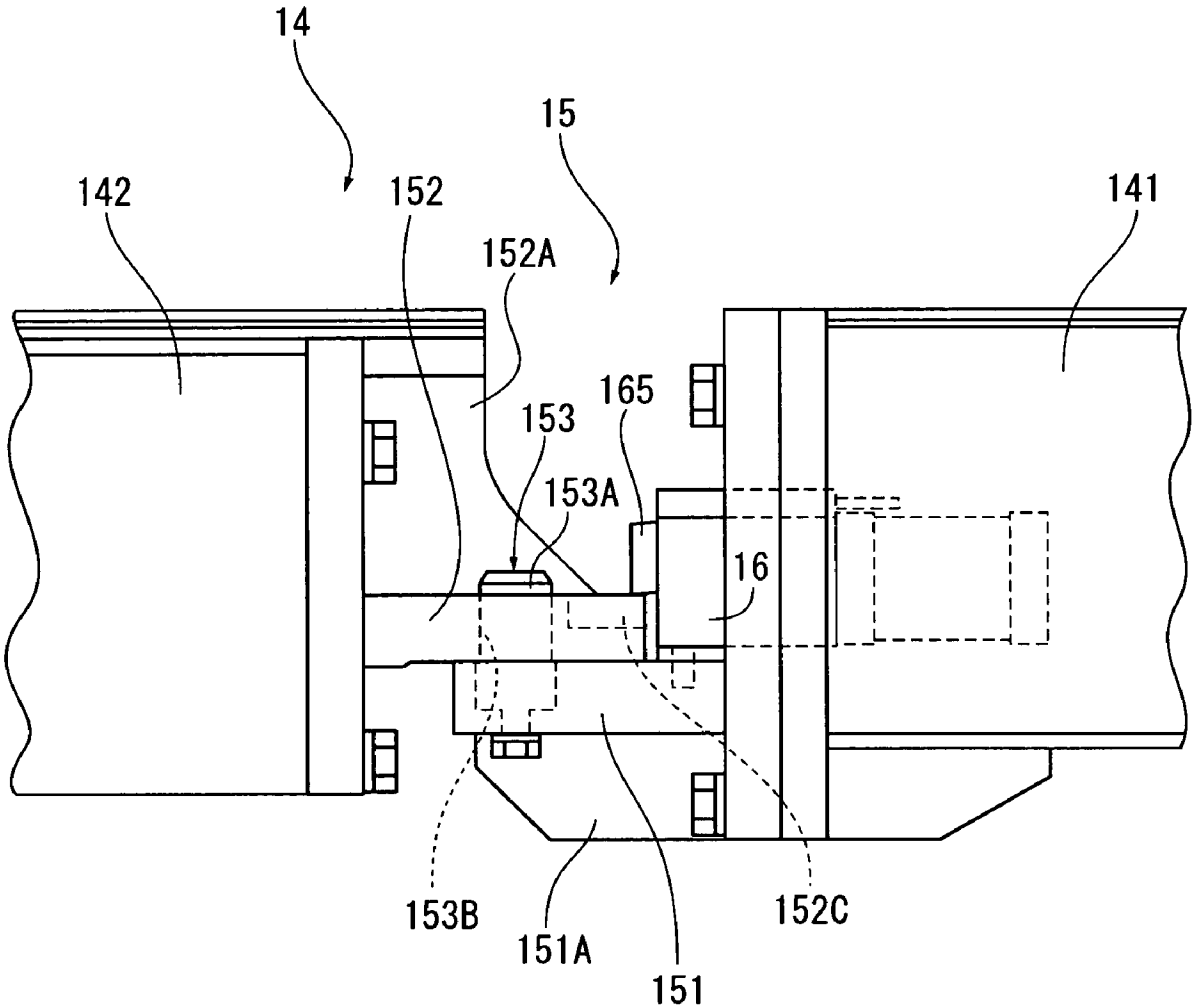
FIG. 3 is a partially enlarged side view showing a bar according to the embodiment of the present invention.
Figure 4:
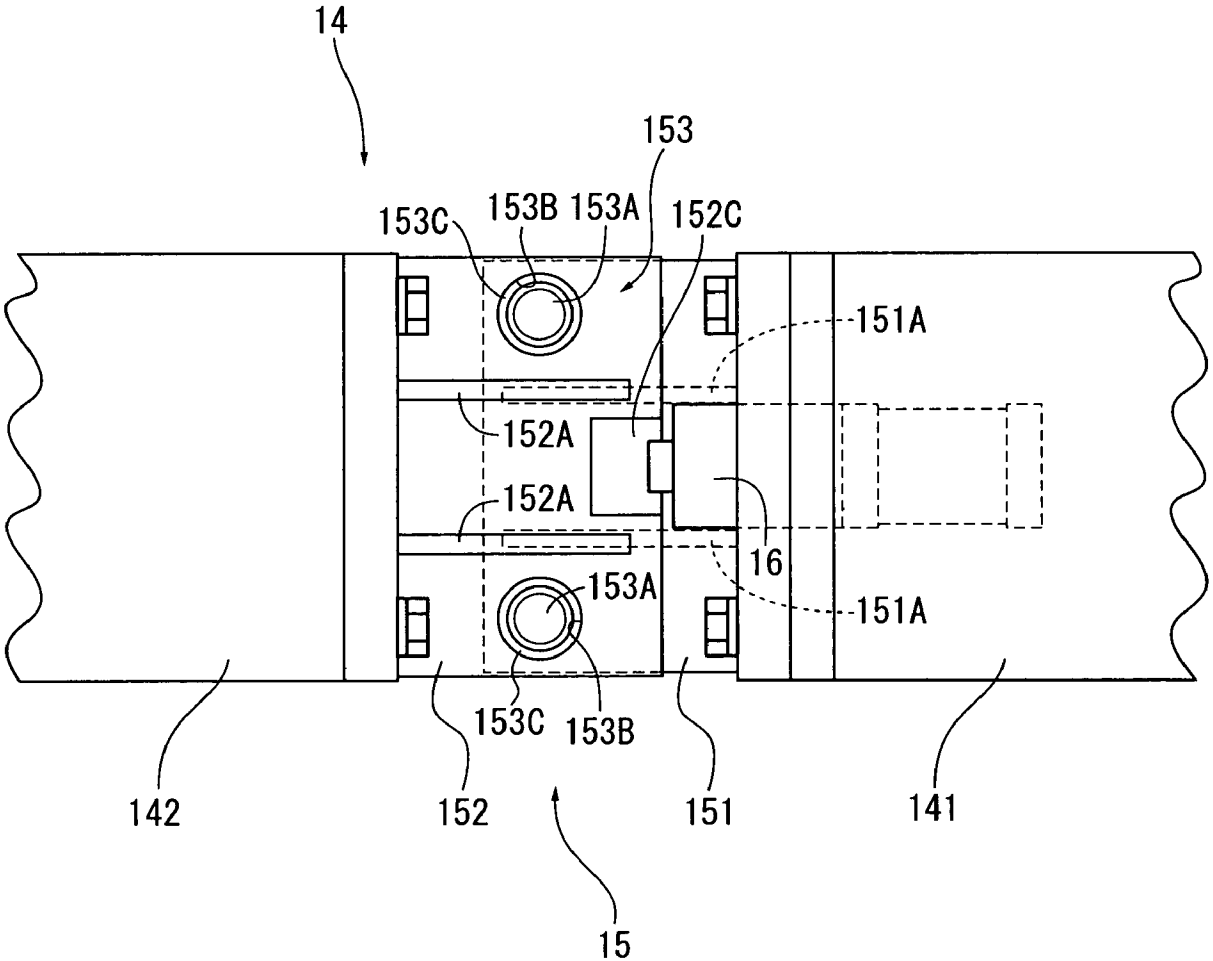
FIG. 4 is a partially enlarged plan view showing the bar according to the embodiment of the present invention.

FIGS. 3 and 4 show a connected portion of the bar 14: FIG. 3 is a side view showing the connected portion of the bar 14 while FIG. 4 is a plan view showing the connected portion of the bar 14. As shown in FIGS. 3 and 4, a connecting device 15 for connecting the fixed bar 141 and the movable bar 142 is provided between an end of the fixed bar 141 and an end of the movable bar 142.

The connecting device 15 includes: a fixed-side connecting portion 151 provided on the fixed bar 141 side; a movable-side connecting portion 152 provided on the movable bar 142 side; a positioning mechanism for positioning the movable-side connecting portion 152 and the fixed-side connecting portion 151; an air clamp 16 (holding means) for fixing the movable-side connecting portion 152 to the fixed-side connecting portion 151; and an air supply device (not shown) for supplying air to the air clamp 16.

The fixed-side connecting portion 151 protrudes from an end of the fixed bar 141 toward the movable bar 142 along a longitudinal direction of the bar 14. The fixed-side connecting portion 151 is a plate-shaped member, which is disposed to extend along a substantially horizontal direction. There is provided on a lower surface of the fixed-side connecting portion 151 a fixed-side rib 151A for reinforcing the fixed-side connecting portion 151. The fixed-side rib 151A is provided at plural points (in the present embodiment, two points), and the plurality of fixed-side ribs 151A extend from the end of the fixed bar 141 to the vicinity of an end of the fixed-side connecting portion 151 along the longitudinal direction of the bar 14. The fixed-side ribs 151A can enhance lift-directional strength (strength in the lift direction L) of the fixed-side connecting portion 151.

The movable-side connecting portion 152 protrudes from an end of the movable bar 142 toward the fixed bar 141 along a longitudinal direction of the bar 14. The movable-side connecting portion 152 is a plate-shaped member, which is disposed to extend along a substantially horizontal direction. There is provided on an upper surface of the movable-side connecting portion 152 a movable-side rib 152A for reinforcing the movable-side connecting portion 152. The movable-side rib 152A is provided at plural points (in the present embodiment, two points), and the plurality of movable-side ribs 152A extend from the end of the movable bar 142 to the vicinity of an end of the movable-side connecting portion 152 along the longitudinal direction of the bar 14. The movable-side ribs 152A can enhance strength (strength in the lift direction L) of the movable-side connecting portion 152.

The positioning mechanism 153 includes: a guide pin 153A provided to the fixed-side connecting portion 151; and a guide hole 153B formed in the movable-side connecting portion 152. The guide pin 153A is provided at two points on a side of the fixed-side rib 151A that is located outward relative to a direction perpendicular to the longitudinal direction of the bar 14 to protrude upwardly (i.e. toward the movable-side connecting portion 152). The guide hole 153B is provided at two points corresponding to the guide pins 153A in the movable-side connecting portion 152. The points at which the guide holes 153B are provided are opposed to sides of the movable-side ribs 152A that are located outward relative to the direction perpendicular to the longitudinal direction of the bar 14. A bushing 153C is attached to an inner circumference of the guide hole 153B.

With this arrangement, the positioning mechanism 153 inserts the guide pin 153A into the guide hole 153B to determine positioning of the fixed-side connecting portion 151 and the movable-side connecting portion 152 in the feed direction F and the clamp direction. The positioning mechanism 153 (i.e., the guide pin 153A and the guide hole 153B) bears a load applied in the clamp direction when the bar 14 is moved in the clamp direction. The bushing 153C, which is provided on the inner circumference of the guide hole 153B, can prevent the guide hole 153B from being worn by repeatedly inserting the guide pin 153A. Accordingly, the bushing 153C is preferably formed from a relatively hard material so as to efficiently prevent the guide hole 153B from being worn. In addition, since the bushing 153C is formed from a material different from that of the guide hole 153B, it is sufficient to replace only the bushing 153C when an inner circumference of the bushing 153C is worn due to a long time usage, thereby facilitating a replacing operation.

Figure 5:
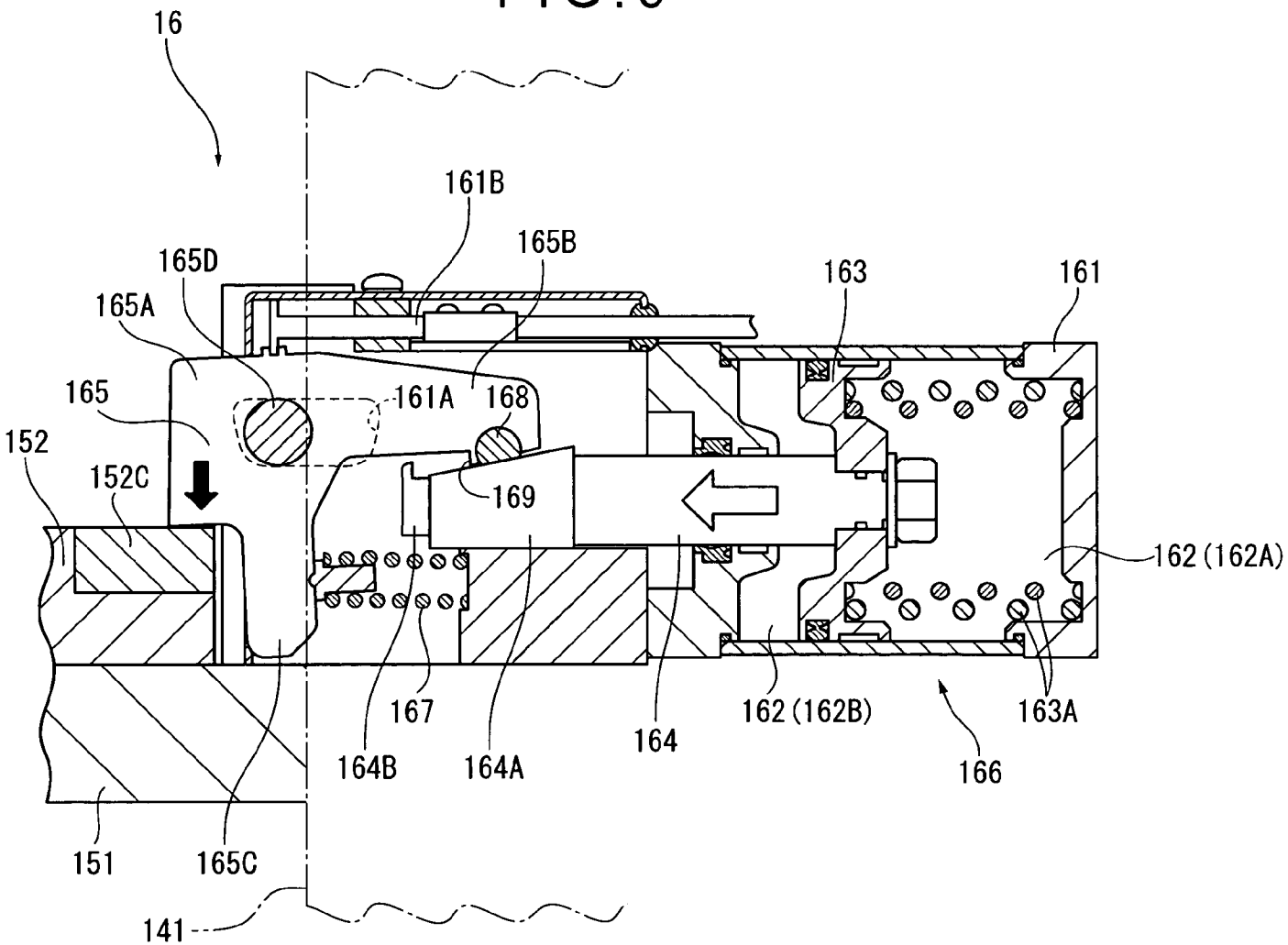
FIG. 5 is a sectional side view showing an air clamp according to the embodiment of the present invention.

FIG. 5 is a cross-sectional side view showing the air clamp 16. As shown in FIG. 5, the air clamp 16 may be driven by air pressure to hold the movable-side connecting portion 152 against the fixed-side connecting portion 151. An air-driven clamp of Model TLA manufactured by Pascal Corporation is exemplarily used in the present embodiment. The air clamp 16 includes: a case 161 housed inside the fixed bar 141; an air chamber 162 formed inside the case 161; a piston 163 provided inside the air chamber 162; a piston rod 164 advanced and retreated in accordance with a movement of the piston 163; and a clamp member 165 (holding member) for clamping the movable-side connecting portion 152 using the advancement and retraction of the piston rod 164. A driving means 166 is provided to include the case 161, the piston 163 and the piston rod 164.

In a cross-section of the fixed bar 141, the entirety of the case 161 is housed inside the fixed bar 141. In addition, in a longitudinal cross-section of the fixed bar 141, substantially the entirety of the case 161 is housed inside the fixed bar 141 while a part of the case 161 protrudes from the end of the fixed bar 141. The case 161 arranged as described above is fixed to the fixed bar 141 by screwing.

Accordingly, since the case 161 is housed inside the fixed bar 141, the air clamp 16 does not largely protrude from the end of the fixed bar 141. Thus, dimensions of the fixed-side connecting portion 151 and the movable-side connecting portion 152 along the longitudinal direction of the bar 14 can be shortened, thereby preventing a strength of the connected portion of the bar 14 from being lowered.

The air chamber 162 is partitioned into two chambers by the piston 163. Inside a first air chamber 162A, a compression spring 163A is provided between the piston 163 and an inner wall of the case 161. The compression spring 163A is adapted to bias the piston 163 toward a second air chamber 162B. An air supply device (not shown) is connected to the two air chambers 162 (162A, 162B) and adapted to supply air of a predetermined pressure into the air chambers 162 (162A, 162B).

One end of the piston rod 164 is fixed to the piston 163. The piston rod 164 penetrates the air chamber 162, and a wedge-shaped member 164A is fixed to the other end side of the piston rod 164 arranged outside the air chamber 162. In addition, a hooked member 164B is provided to the other end side of the piston rod 164, the hooked member 164B being positioned at a further tip end side of the piston rod 164 than the wedge-shaped member 164A.

A lower side of the wedge-shaped member 164A is slidable relative to the case 161 in an axial direction of the piston rod 164. An upper side of the wedge-shaped member 164A is formed to be a sloping surface such that a distance between the upper side and the lower side is reduced toward the tip end side of the piston rod 164. By the sloping surface, the entirety of the wedge-shaped member 164A is tapered such that the wedge-shaped member 164A is sharpened toward the tip end side. The hooked member 164B is shaped like a hook that upwardly protrudes.

The clamp member 165 is provided with a clamp portion 165A for holding the movable-side connecting portion 152, an operating portion 165B for transferring the advancement and retraction of the piston rod 164 to the clamp member 165 and a spring mounting portion 165C on which a spring 167 for biasing the clamp member 165 against the piston rod 164 is mounted. The clamp member 165 has rotation shafts 165D on both sides in a direction perpendicular to the advancing and retracting direction (the longitudinal direction of the bar 14), and the rotation shafts 165D are inserted into an elongated hole 161A formed in the case 161 (shown by a dotted line in FIG. 6). A longer axis of the elongated hole 161A is arranged along the longitudinal direction of the fixed bar 141, such that the clamp member 165 is supported by the rotation shafts 165D rotatably relative to the case 161 and slidably in the longitudinal direction of the bar 14.

The clamp portion 165A is protrudable from the case 161, and a lower side of a tip end side of the clamp portion 165A is adapted to abut on an upper side of the movable-side connecting portion 152. The lower side of the clamp portion 165A is preferably flat so as to stably abut on the upper surface of the movable-side connecting portion 152. The clamp portion 165A abuts on the upper side of the movable-side connecting portion 152 to hold the movable-side connecting portion 152 against the fixed-side connecting portion 151. With this arrangement, the movable-side connecting portion 152 is fixed against the fixed-side connecting portion 151 in the lift direction L. Accordingly, the fixed-side connecting portion 151 and the clamp portion 165A bear a load applied in the lift direction L when the bar 14 is moved in the lift direction L.

The operating portion 165B abuts on the wedge-shaped member 164A and is provided with a follower 168 that is rotatable relative to the operating portion 165B.

A step portion 169 is provided on an end of the operating portion 165B that is closer to the fixed bar 141 than the follower 168. The step portion 169 is engageable with the hooked member 164B of the piston rod 164.

The spring mounting portion 165C extends downwardly from the rotation shaft 165D, and the extending direction of the spring mounting portion 165C is substantially perpendicular to an extending direction of the operating portion 165B around the rotation shaft 165D. The spring 167 is mounted between a surface of the spring mounting portion 165C that is opposite to the end side of the fixed bar 141 and the case 161. The spring 167 biases the clamp member 165 in a direction in which the clamp member 165 is rotated about the rotation shaft 165D. The biasing force presses the follower 168 of the operating portion 165B to the wedge-shaped member 164A with a predetermined biasing force. The biasing force biases the follower 168 to finely follow the wedge-shaped member 164A in accordance with the movement of the piston rod 164, thereby reliably operating the clamp member 165.

In addition, the air clamp 16 is provided with a limit switch 161B for detecting an excessive movement of the clamp member 165.

When air is supplied into one of the first air chamber 162A in the air clamp 16, the piston 163 is applied with the air pressure in addition to the biasing force by the compression spring 163A, such that the piston 163 is moved toward the second air chamber 162B. Then, the piston rod 164 is moved in accordance with the movement of the piston 163, such that the wedge-shaped member 164A is moved toward the tip end of the fixed bar 141. At this time, while the follower 168 of the clamp member 165 is rotated on the upper surface of the wedge-shaped member 164A, the vertical thickness of the wedge-shaped member 164A is gradually increased. Accordingly, the clamp member 165 is rotated about the rotation shaft 165D against the biasing force of the spring 167. In addition, the follower 168 is applied with a pressing force that presses the clamp member 165 toward the movable bar 142 along the longitudinal direction of the bar 14 by the sloping surface of the upper surface of the wedge-shaped member 164A, such that the rotation shaft 165D slides relative to the elongated hole 161A of the case 161 to move the clamp member 165. In short, the clamp portion 165A is rotated as soon as the clamp portion 165A protrudes from the case 161 to approach the fixed-side connecting portion 151.

In accordance with the rotation operation and the advancing and retracting operation, the clamp member 165 moves along the longitudinal direction of the bar 14 and rotated downwardly. Subsequently, the clamp portion 165A is applied with a predetermined force to abut on the movable-side connecting portion 152 and holds the movable-side connecting portion 152 against the fixed-side connecting portion 151.

An abutment member 152C is provided on a portion of the movable-side connecting portion 152 to be in contact with the clamp portion 165A. The abutment member 152C is formed as a component that is separated from the movable-side connecting portion 152. The abutment member 152C is formed of a relatively hard material and prevents the movable-side connecting portion 152 being worn by repeatedly bringing the clamp portion 165A in contact with the movable-side connecting portion 152. In addition, since the abutment member 152C is formed as the component separate from the movable-side connecting portion 152, it is sufficient to replace only the abutment member 152C when the abutment member 152C is worn due to a long time usage, thereby facilitating a replacing operation.

Since the piston 163 is biased by the predetermined biasing force applied by the compression spring 163A, less air pressure is required for the clamp member 165 to apply the predetermined claming force, thereby making an improvement in power saving. Since the predetermined clamping force can be provided by a small pressure according to the arrangement, an air-pressure clamp can be used instead of a conventional high-pressure hydraulic clamp, thereby simplifying an arrangement, control and operation of the connecting device.

Even when air supply is suspended due to some troubles, the movable-side connecting portion 152 can be continuously held due to the biasing force applied by the compression spring 163A, thereby reliably preventing a problem such as a disconnection.

Further, since the clamping force is produced by pneumatically operating the piston 163, it takes shorter time to operate the piston 163 as compared to a hydraulic operation of the piston, thereby shortening a die replacing time.

On the other hand, in order to release the holding of movable-side connecting portion 152 by the air clamp 16, air is supplied into second air chamber 162B.

Figure 6:
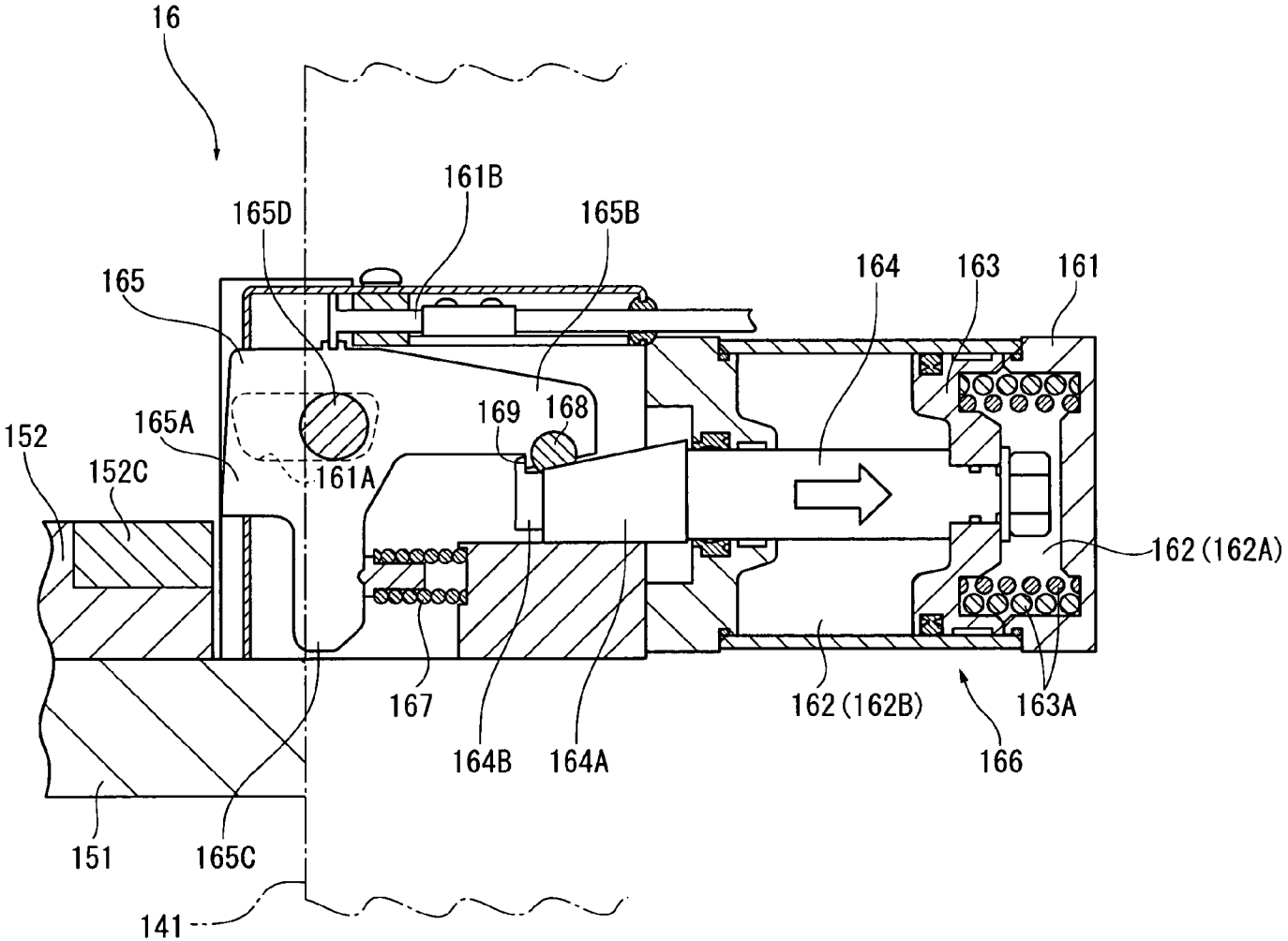
FIG. 6 is a sectional side view showing the air clamp according to the embodiment of the present invention.

FIG. 6 is a cross-sectional side view showing the air clamp 16 when the holding of the movable-side connecting portion 152 is released. In FIG. 6, air is supplied into the second air chamber 162B, such that the piston 163 is moved toward the first air chamber 162A against the biasing force applied by the compression spring 163A. The piston rod 164 is moved in accordance with the movement of the piston 163, such that the wedge-shaped member 164A is retracted. Then, the clamp member 165 is retracted in accordance with the movement of the piston rod 164 to be rotated about the rotation shaft 165D, such that the clamp portion, 165A is housed inside the case 161.

Now, operations of the transfer press 1 will be described.

In transferring the workpiece 2, the transfer feeder 41 performs the following three-dimensional operations: a feed-and-return operation for reciprocating the feed carrier 52 on the bar 14 in the workpiece transfer direction T; a lifting up-and-down operation (lifting-down operation) for lifting up and down the bar 14; and a clamp-and-unclamp operation for reciprocating the bar 14 in a direction horizontally perpendicular to the workpiece transfer direction T. Then, by appropriately reciprocating a workpiece holder held by the feed carrier 52 in the feed direction F, the lift direction L and the clamp direction, the workpiece 2 is sequentially transferred from the lower die 13 of the upstream side (left side in FIG. 1) to the lower die 13 of the downstream side (right side in FIG. 1).

Since the workpiece holders are also replaced when the die 11 is replaced, the workpiece holder needs to be placed on the moving bolster 30 as well as the bar 14 to be transferred from a workpiece transfer region to the outside. At this time, since the bar 14 is supported by the lift/clamp device 80 provided on the frame 33A, the transfer operation may be interrupted.

Accordingly, the movable bar 142 of the bar 14 is separated to be detached from the fixed bar 141, and the movable bar 142 is placed on a bar receiving table (not shown) of the moving bolster 30.

Figure 7:
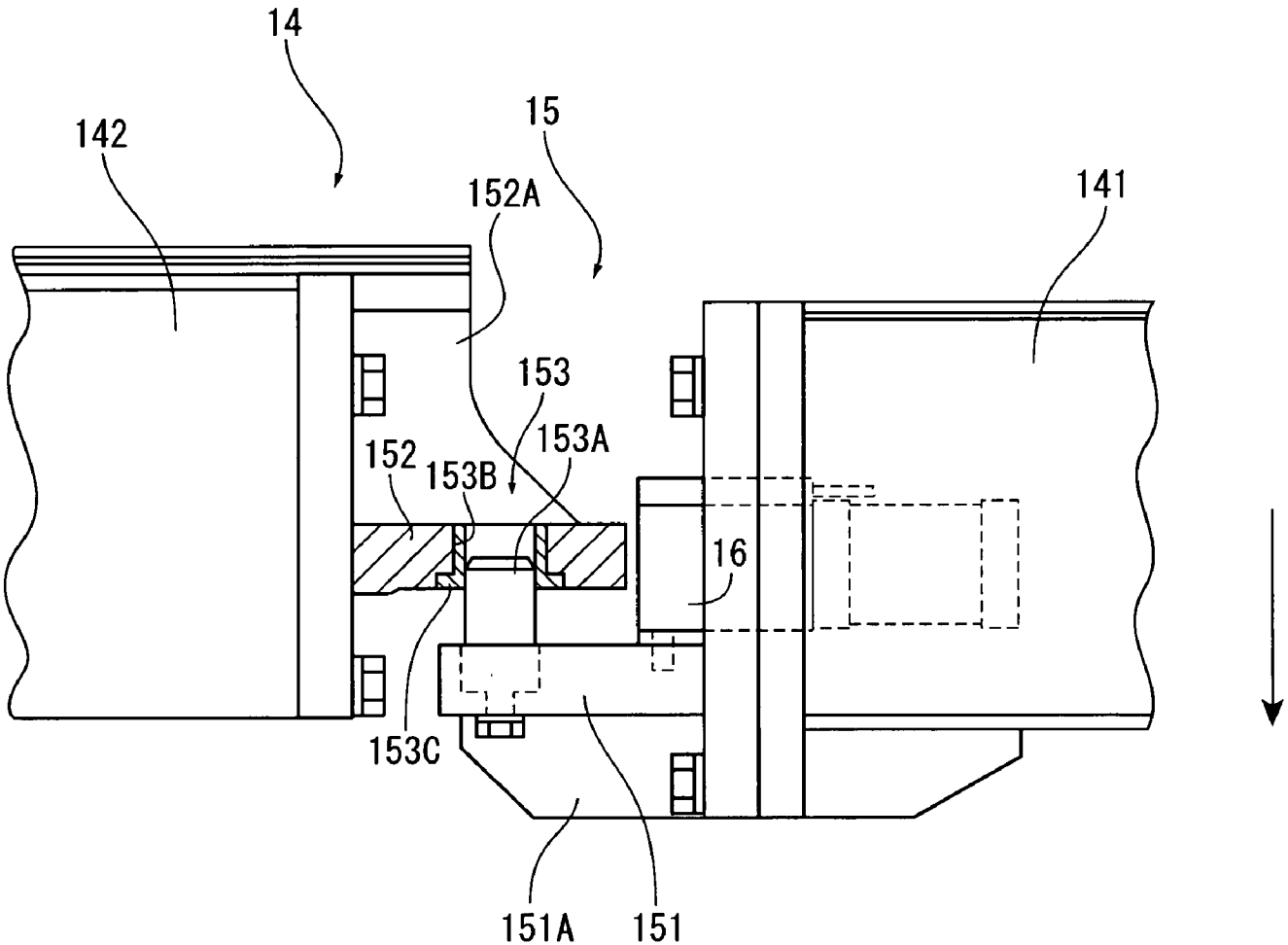
FIG. 7 is a partially enlarged side view showing the bar according to the embodiment of the present invention.

Initially, while the bar 14 is placed on the bar receiving table, air is supplied into the air chamber 162B of the air clamp 16, such that the clamp member 165 is rotated to be retracted. FIG. 7 is a cross-sectional side view showing the air clamp 16 when the clamp member 165 is retracted. As shown in FIG. 7, since the clamp member 165, which has been retracted, is housed inside the case 161, the clamp member 165 does not protrude from the upper side of the movable-side connecting portion 152. When the fixed bar 141 is downwardly moved in this state as in FIG. 7, the guide pin 153A is disengaged from the guide hole 153B, such that the movable bar 142 is disconnected from the fixed bar 141. Subsequently, the moving bolster 30 is moved to be transferred to the outside of the transfer press 1.

An operation to attach the bar 14 on which the next workpiece holders are attached to the transfer feeder 41 is performed in a manner that is reverse to the above-described detaching steps. Specifically, the moving bolster 30 on the bar receiving table of which the bar 14 is initially placed is moved to be transferred into the transfer press 1. The fixed bar 141 is moved such that the fixed-side connecting portion 151 is positioned at a lower side of the movable-side connecting portion 152. Then, the fixed bar 141 is upwardly moved to insert the guide pin 153A into the guide hole 153B.

Air is supplied into the first air chamber 162A, such that the piston 163 is moved toward the end of the fixed bar 141. Subsequently, the clamp member 165 protrudes from the case 161 and rotates about the rotation shaft 165D to downwardly move the clamp portion 165A, such that the clamp portion 165A holds the movable-side connecting portion 152 against the fixed-side connecting portion 151.

Note that the bar receiving table may be provided with the lifting-up-and-down device. In addition, a means for moving the movable bar 142 in the clamp direction may be provided. In this case, in the die replacing operation performed outside the main body of the transfer press 1, the space between the bars 14 can be enlarged when the die 11 is placed on another moving bolster 30, thereby facilitating the replacement operation of the die 11.

It should be noted that the invention is not limited to the exemplary embodiments above, but includes modifications and improvements as long as an advantage of some aspects of the invention can be achieved.

As long as the holding means includes a holding member that is driven to be advanced and retracted, the holding means may not be necessarily movable in a direction to be moved toward and away from the fixed-side connecting portion. Further, although the holding means is moved toward and away from the fixed-side connecting portion simultaneously with the advancement and retraction of the holding means, the holding means is not limited thereto. The operation of the holding means to be moved close and away may be performed separately from the operation of the holding means to be advanced and retracted.

The movable-side connecting portion may not be arranged above the fixed-side connecting portion but the movable-side connecting portion may be exemplarily arranged below the fixed-side connecting portion. In addition, the movable-side connecting portion and the fixed-side connecting portion may not be superposed in the up-and-down direction, but the connecting portion may be in contact with other at vertical surfaces.

Note that the method for driving the workpiece transfer apparatus is not limited to the above-described embodiments. For instance, the drive carrier may be supported by the fixed bar and a linear motor may be provided between the fixed bar and the drive carrier. In this case, a connecting mechanism for connecting the drive carrier and the feed carrier is provided in the vicinity of a bar separating position.

The guide pin and the guide hole may not be provided respectively to the fixed-side connecting portion and the movable-side connecting portion, but the guide pin and the guide hole may be exemplarily provided respectively to the movable-side connecting portion and the fixed-side connecting portion. In short, the guide pin may be provided to either of the fixed-side connecting portion or the movable-side connecting portion while the guide hole may be provided to the other of the two.

Although the best arrangement and method for implementing the present invention has been disclosed above, the present invention is not limited thereto. In other words, while the present invention has been described with reference to the specific embodiments and the drawings thereof, various modifications may be made to shapes, materials, numeral quantity and any other detailed arrangement as disclosed in the above-described embodiments by those of ordinary skill in the art without departing from the spirit and scope of the invention.

Accordingly, the above-disclosed shapes, materials and the like are merely described as examples for easy understanding of the present invention, so that the present invention is not limited thereto. The present invention shall include a description with names of components excluding a part or all of the limitation on the shapes and materials, etc.

INDUSTRIAL APPLICABILITY

The present invention is applicable to a transfer press that performs a plurality of pressing steps and sequentially transfers a workpiece to a subsequent step and also applicable to a tandemly-arrayed tandem press.

What is claimed is:

1. A workpiece transfer apparatus that transfers a workpiece to be pressed by a press machine, comprising:

a bar assembly including a workpiece holder that holds the workpiece, at least part of the bar assembly being arranged substantially parallel to a transfer direction of the workpiece, wherein the bar assembly includes:

a fixed bar adapted to be fixed within the press machine;

a movable bar detachable from the fixed bar; and a connecting device that selectively connects the fixed bar and the movable bar, the connecting device includes:

a fixed-side connecting portion that protrudes from an end of the fixed bar toward the movable bar;

a movable-side connecting portion that protrudes from an end of the movable bar toward the fixed bar to be superimposed on the fixed-side connecting portion; and holding means for holding the movable-side connecting portion, and wherein the holding means includes:

a holding member that is adapted to be advanced and retracted in a longitudinal direction of the fixed bar and when advanced in the longitudinal direction of the fixed bar, abuts an outer surface of the movable-side connecting portion and presses the movable-side connecting portion toward and against the fixed-side connecting portion to thereby hold the movable-side connecting portion against the fixed-side connecting portion; and driving means that is provided within the fixed bar for driving the holding member.

2. The workpiece transfer apparatus according to claim 1, wherein the holding member is movable in a direction toward and away from the fixed-side connecting portion.

3. The workpiece transfer apparatus according to claim 1, wherein the movable-side connecting portion is arranged above the fixed-side connecting portion such that the holding member abuts an upper surface of the movable-side connecting portion and presses the movable-side connecting portion downward against the fixed-side connecting portion.

4. The workpiece transfer apparatus according to claim 1, wherein:

a guide pin is provided on one of the fixed-side connecting portion and the movable-side connecting portion to protrude toward the other of the fixed-side connecting portion and the movable-side connecting portion, and a guide hole into which the guide pin is inserted is provided in the other of the fixed-side connecting portion and the movable-side connecting portion.

5. The workpiece transfer apparatus according to claim 1, wherein the holding member is positioned on a side of the fixed bar when the movable bar is transferred while the holding member is moved by the driving means in the longitudinal direction of the fixed bar to be positioned on a side of the movable bar when the movable bar is connected with the fixed bar.

6. The workpiece transfer apparatus according to claim 1, wherein the driving means is pneumatically driven.

7. A press machine comprising:

a workpiece transfer apparatus that transfers a workpiece to be pressed by a press machine, wherein the workpiece transfer apparatus includes a bar assembly including a workpiece holder that holds the workpiece, and wherein at least part of the bar assembly is arranged substantially parallel to a transfer direction of the workpiece, wherein the bar assembly includes:

a fixed bar fixed within the press machine;

a movable bar detachable from the fixed bar; and a connecting device that selectively connects the fixed bar and the movable bar, wherein the connecting device includes:

a fixed-side connecting portion that protrudes from an end of the fixed bar toward the movable bar;

a movable-side connecting portion that protrudes from an end of the movable bar toward the fixed bar to be superimposed on the fixed-side connecting portion; and holding means for holding the movable-side connecting portion, and wherein the holding means includes:

a holding member that is adapted to be advanced and retracted in a longitudinal direction of the fixed bar and when advanced in the longitudinal direction of the fixed bar, abuts an outer surface of the movable-side connecting portion and presses the movable-side connecting portion toward and against the fixed-side connecting portion to thereby hold the movable-side connecting portion against the fixed-side connecting portion; and driving means that is provided within the fixed bar and for driving the holding member.

8. The workpiece transfer apparatus according to claim 1, wherein the holding member is rotatable about a rotation shaft extending in a direction perpendicular to the longitudinal direction.

9. The press machine according to claim 7, wherein the holding member is rotatable about a rotation shaft extending in a direction perpendicular to the longitudinal direction.

* * * * *